United States Patent [19]

Brown

[11] Patent Number: 4,991,242

[45] Date of Patent: Feb. 12, 1991

[54] PATIENT TABLE COVER AND METHOD

[76] Inventor: Timothy E. Brown, 107 E. McKinley St., Tempe, Ariz. 85281

[21] Appl. No.: 539,562

[22] Filed: Jun. 18, 1990

[51] Int. Cl.[5] ..... A47G 9/00; A47G 9/04

[52] U.S. Cl. ..... 5/60; 5/484; 5/496; 108/90; 150/158; 378/209

[58] Field of Search ..... 5/508, 60, 484, 482, 5/500, 502, 496, 498; 297/219; 150/158; 269/322, 327; 108/90; 378/209

[56] References Cited

U.S. PATENT DOCUMENTS

| | | | |
|---|---|---|---|
| 3,956,782 | 5/1976 | Morrison | 5/484 |
| 4,627,363 | 12/1986 | Jones | 108/90 |
| 4,910,819 | 3/1990 | Brown | 5/484 |

*Primary Examiner*—Alexander Grosz
*Attorney, Agent, or Firm*—Harry M. Weiss

[57] ABSTRACT

A patient table assembly having a cushion with a cover. The cushion has side flaps, which connect to the table. The cover, disposed around the cushion, has bottom sheets, which connect to each other, and which have slots through which the flaps can pass through.

6 Claims, 1 Drawing Sheet

PATIENT TABLE COVER AND METHOD

BACKGROUND OF INVENTION

1. Field of Invention

The invention generally relates to a patient table cushion cover and method, and, in particular, the invention relates to a patient table cushion cover and method having a plurality of connector flaps with slots in order to provide secure and rapid attachment and detachment of the cove to the cushion.

2. Description of Prior Art

Angiographic and cardiac catheterization machines are heavily used hospital equipments, utilized for somewhat specific diagnostic procedures. The angiographic machine is utilized to perform neuroradiologic studies, while the cardiac catheterization machine is utilized in cardiac diagnostic procedures.

The angiographic and cardiac catheterization machines include a patient table about ten feet long. In a typical diagnostic procedure, a patient is placed either in a supine or prone position on a patient cushion that rests upon the table. Usually, the cushion and table have complimentary hook and loop type strips and flaps that maintain the cushion in a fixed position on the table.

The table rests upon a base structure that houses much of the machine's electromechanical motorization and control components. The table is also disposed above an x-ray tube assembly.

One problem with the prior art patient table cushion is that body fluids, such as blood and urine, and disinfectant solutions, flow from the patient, off the cushion and table top, onto the base structure and x-ray tube assembly. The fluids and solutions penetrate to the interior of the base structure and x-ray tube assembly, and flow onto the electromechanical components. A result of the flow of the fluids and solutions is a need to clean the machine. The machine cannot be used for the diagnostic procedures while being cleaned. Accordingly, the flow of the fluids and solutions reduces utilization of the machine. Also, it is impractical to thoroughly clean the machine as a matter of routine. What usually remains after the cleaning is an unsanitary residue. Moreover, there is a cumulative increase in the residue over the life of the machine. Therefore, the machine is frequently used under cumulatively unsanitary conditions.

U.S. Pat. No. 4,910,819 which issued on Mar. 27, 1990 in the name of the applicant of this patent application discloses a protective covering and method to protect against spills, etc. on a cushion that rests on a baseplate of a CT-scanner, however, a need exists to provide a more improved protective covering and method which has an even better technique to permit attachment of the protective cover to the cushion and the subsequent detachment therefrom.

SUMMARY OF THE INVENTION

According to the present invention, a table assembly is provided for a patient. This table assembly includes a table top, a cushion connected to the table top, and a cover connected to the cushion, wherein the cushion has opposite side portions, each having a plurality of flaps connecting to the table top, and wherein the cover has opposite side portions, each having a corresponding plurality of connector sheets, each connector sheet having a slot for passing through the respective flap for connection to the table top.

By using the cover disposed over the cushion, the flow of body fluids onto the base structure and x-ray tube assembly is minimized.

The foregoing and other objects, features and advantages will be apparent from the following description of the preferred embodiment of the invention as illustrated in the accompanying drawings.

DESCRIPTION OF THE PREFERRED EMBODIMENT

Figure 1:
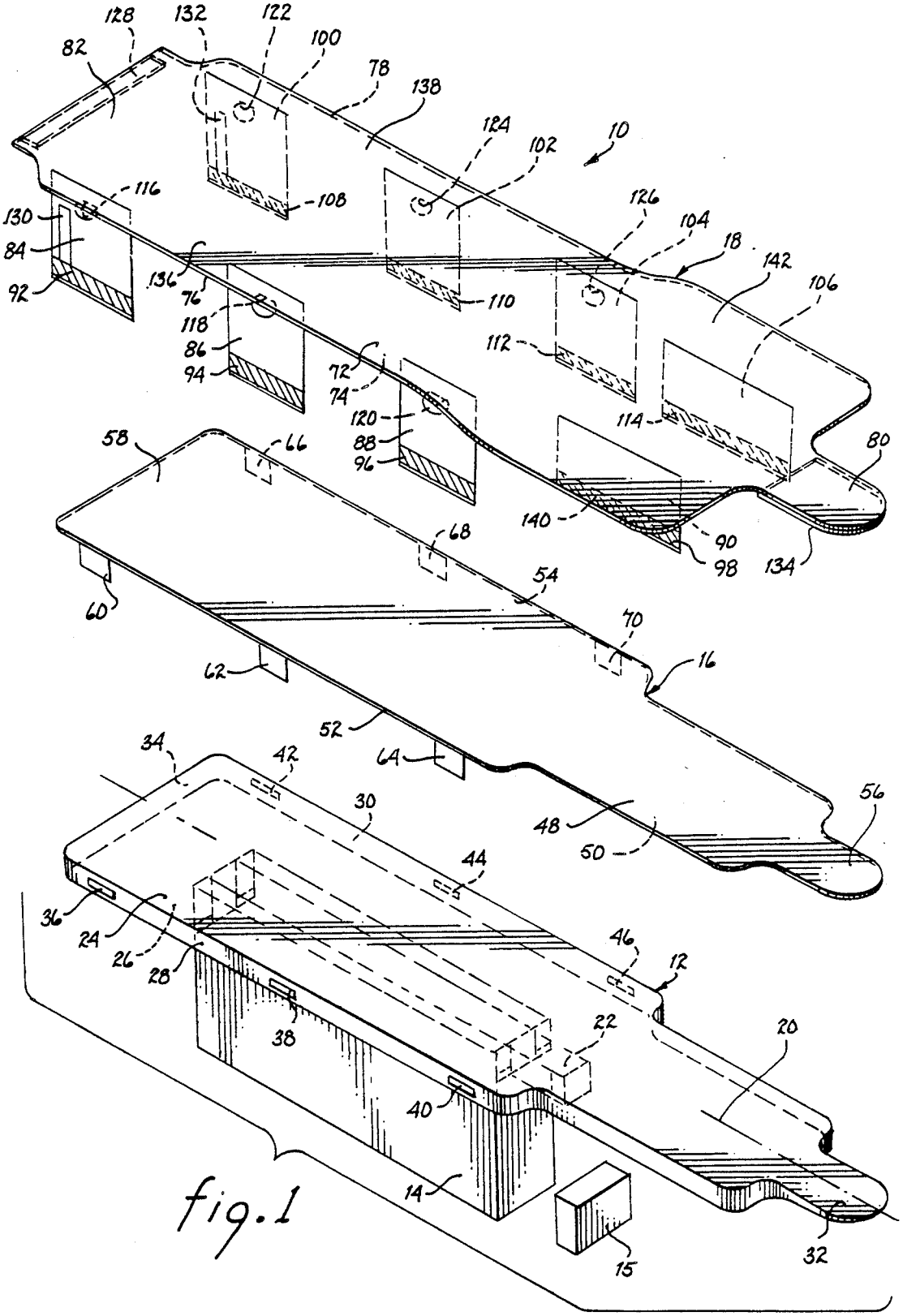
FIG. 1 is an exploded, perspective view of a patient table assembly according to the present invention.

As shown in FIG. 1, a patient table assembly 10 is provided. Assembly 10 includes a table top 12, which has a base structure 14 and an x-ray tube assembly 15. Assembly 10 also has a cushion 16, which is connected to the table top 12, and has a cover 18, which is connected to the cushion 16.

Table top 12, which cantilevers from base 14 and which is supported by base 14, is movable back or forth relative to base 14 along an axis 20. Base 14 has a track 22, on which table top 12 is movably mounted.

Table top 12 has a top surface 24, a bottom surface 26, a near side portion 28, a far side portion 30, a head end portion 32, and a foot end portion 34. Near side portion 28 has three tabs 36, 38, 40. Far side portion 30 also has three tabs 42, 44, 46. Each of the tabs is made of a minute hook and eye type material. Such materials adhere when pressed together; and are sold under the trademark VELCRO.

Cushion 16 also has a top surface 48, a bottom surface 50, a near side portion 52, a far side portion 54, a head end portion 56, and a foot end portion 58. Bottom surface 50 has three near flaps 60, 62, 64, which are disposed next to near side portion 52, and which adhere to respective tabs 36, 38, 40. Bottom surface 50 also has three far flaps 66, 68, 70, which are disposed next to far side portion 54 and which adhere to respective tabs 42, 44, 46. Flaps 60, 62, 64, 66, 68, 70 are also made of the minute hook and eye type material sold under the trademark VELCRO.

Cover 18 also has a top surface 72, a bottom surface 74, a near side portion 76, a far side portion 78, a head end portion 80 and a foot end portion 82. Bottom surface 74 has four near connector sheets 84, 86, 88, 90, which have respective minute hook and eye type strips 92, 94, 96, 98. Bottom surface 74 also has four far connector sheets 100, 102, 104, 106, which have respective minute hook and eye type strips 108, 110, 112, 114. Near connector sheets 84, 86, 88 have respective D-shaped slots or holes 116, 118, 120. Far connector sheets 100, 102, 104 have respective D-shaped holes 122, 124, 126. Bottom surface 74 has a minute hook and eye type strip 128, which is disposed adjacent to foot end portion 82. Connector sheets 84, 100 have respective vertical, minute hook and eye type strips 130, 132, which adhere to strip 128, when folded over. Head end portion 80 has a pocket sheet 134, which is disposed adjacent to bottom surface 74, and which forms a pocket that receives cushion head end portion 56.

During assembly, cover 18 is placed over cushion 16. Pocket sheet 134 is fitted over cushion head end 56. Sheets 84, 86, 88, 90, and sheets 100, 102, 104, 106 are folded under cushion 16. Flaps 60, 62, 64, 66, 68, 70 are then passed through respective D-shaped holes 116, 118, 120, 122, 124, 126. Strips 92, 94, 96, 98 are then attached to respective strips 108, 110, 112, 114. Then strip 128 is attached to strips 130, 132. Flaps 60, 62, 64, 66, 68, 70 are then attached to respective tabs 36, 38, 40, 42, 44, 46. Near side portion 76 and far side portion 78 extend outwardly, beyond the stitched edges of respective sheets 84, 86, and respective sheets 100, 102, 104, thereby forming edge projections or flaps 136, 138 near bottom end 82, and forming enlarged edge projections 140, 142 near top end 80, for reducing fluid flow over units 14, 15.

The material of cover 18, in this embodiment, is 20 mil PVC vinyl sheeting. Sheets 84, 86, 88, 100, 102, 104 are joined to bottom surface 74 at their upper edges by stitching with nylon thread. Strips are attached to sheets using the same type of thread and stitching.

The advantages of table assembly 10 is that the flow of body fluids onto base 14 and x-ray tube assembly 15 is minimized. While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows.

I claim:

1. A patient table assembly comprising:

a table top having a base;

a cushion connected to the table top;

said table top having a first side portion and a second side portion;

said cushion having a first side portion and a second side portion;

a cover having a first side portion and a second side portion;

first and second flaps respectively connecting the cushion and table top first side portions and the cushion and table top second side portions;

first and second sheets having outer edges joined to the cover side portions and folded under the cushion and having connectable inner edges; and said first and second sheets respectively having first and second slots for passing therethrough respectively the first and second flaps.

2. The assembly of claim 1, wherein the cushion has a head end portion; and the cover has a head end portion having pocket sheet means on a bottom surface thereof for forming a pocket for receiving the cushion head end portion.

3. The assembly of claim 1, wherein the cover first and second edge portions have respective projections extending outwardly from the cover sheets for minimizing fluid flow toward the base from the cover.

4. The assembly of claim 1, wherein the flaps have respective minute hook and eye type connector strips; and the sheets have respective minute hook and eye type connector strips.

5. The assembly of claim 1, wherein the cover has a minute hook and eye type strip disposed on a bottom surface of the cover near a foot end portion of the cover; and the sheets of the cover have respective minute hook and eye type strips for attachment to the foot end strip.

6. A method of providing a protective cover for a patient table assembly including the steps of:

providing a table top mounted on a base;

providing a cushion having first and second connector flaps for connection to the table top;

disposing a cover having a bottom surface with first and second connector sheets over said cushion said cover having first and second slots in the connector sheets;

passing the flaps through the respective sheet slots;

folding the sheets under the cushion;

connecting together the sheets at the folded ends thereof; and connecting the flaps to the table top.

* * * * *